United States Patent [19]

Liebermann

[11] 4,381,197

[45] Apr. 26, 1983

[54] WARM CONSOLIDATION OF GLASSY METALLIC ALLOY FILAMENTS

[75] Inventor: Howard H. Liebermann, Gloversville, N.Y.

[73] Assignee: General Electric Company, Schenectady, N.Y.

[21] Appl. No.: 171,714

[22] Filed: Jul. 24, 1980

[51] Int. Cl.[3] ..... B22F 3/00

[52] U.S. Cl. ..... 419/24; 79/229; 148/104; 148/31.55; 419/29

[58] Field of Search ..... 75/200, 226, 229; 148/104, 31.55

[56] References Cited

U.S. PATENT DOCUMENTS

| | | | |
|---|---|---|---|
| 4,079,430 | 3/1978 | Ohya | 360/126 |
| 4,197,146 | 4/1980 | Frischmann | 148/31.55 |
| 4,201,837 | 5/1980 | Lupinski | 428/457 |
| 4,298,382 | 11/1981 | Stempin | 75/202 |

FOREIGN PATENT DOCUMENTS 53-57170 5/1978 Japan .

OTHER PUBLICATIONS

Miller et al., "The Production and Consolidation of Amorphous Metal Powders", Presented Second Int'n'l Conf on Rapid Solidification Reston VA. 3–80.

Wood, "Welding & Compacting Metallic Glasses", *Machine & Tool Blue Book.*

Udin et al., *Welding for Engineers,* p. 1954.

*Primary Examiner*—Brooks H. Hunt

*Attorney, Agent, or Firm*—Stephen S. Strunck; James C. Davis, Jr.; James Magee, Jr.

[57] ABSTRACT

Filaments of glassy metallic alloys prepared by chill block melt-spinning are consolidated under heat and pressure by uniaxial pressing to form discrete self-supporting glassy metallic alloy bodies of substantially uniform composition.

17 Claims, 9 Drawing Figures

WARM CONSOLIDATION OF GLASSY METALLIC ALLOY FILAMENTS

BACKGROUND OF THE INVENTION

This invention relates to the consolidation of filamentary glassy metallic alloys under heat and pressure by uniaxial pressing to form discrete self-supporting glassy metallic alloy bodies of substantially uniform composition.

Glassy metallic alloys, also commonly referred to as amorphous metallic alloys, do not exhibit the regular atomic structural periodicity of metals in the crystalline state. Glassy metallic alloys, therefore, in contrast to crystalline metals, do not exhibit well-defined peaks during X-ray diffraction measurements. From such diffraction measurements, however, it has been determined that amorphous metals have no long range structure and, in that respect, their atomic structures closely resemble those of the precursor liquid state.

Glassy metallic alloys generally possess physical properties such as hardness and strength far in excess of their crystalline counterparts. The magnetic properties of magnetic glassy metallic alloys generally also differ from those of their crystalline counterparts and are of considerable interest to manufacturers of electrical equipment. Since glassy magnetic metals, unlike normal crystalline magnetic metals, have no long range atomic order in their structure, the directionality of properties such as magnetization normally associated with crystal anisotropy is absent. Also, unlike normal metals, glassy metals are extremely homogeneous, being devoid of compositional heterogeneity, inclusions and structural defects. The lack of magnetic directionality gives metallic glasses good d-c magnetic properties including extremely low field requirements for saturation which allows magnetization reversal at extremely low fields (i.e., a low coercive field). Magnetic materials having low coercive field and low field requirements for saturation, i.e., high permeability, are commonly referred to as magnetically soft. Typical sofe magnetic glassy metallic alloys in ribbon form are disclosed in U.S. Pat. No. 4,038,073 to O'Handley et al. which is herein incorporated by reference in its entirety.

Amorphous structures can be obtained by several techniques. Electroplating, vapor deposition, and sputtering are all techniques where the material is deposited on an atom-by-atom basis. Under appropriate conditions, the atoms are "frozen" in-situ on contact and usually cannot diffuse into the lower energy configurations associated with a more stable lattice. The resulting metastable structure is a non-crystalline glassy one. These processing methods, however are not economically feasible for producing large commercial quantities.

Another method for producing glassy structures in some metals is by cooling rapidly from the liquid melt. Two major conditions apply in achieving the glassy structure by this method. First, the composition should be selected to have a high glass transition temperature, $T_g$, and a low melting temperature, $T_m$. Specifically, the $T_g/T_m$ ratio should be as large as possible. Second, the liquid should be cooled as rapidly as possible from above $T_m$ to below $T_g$. In practice, it is found that to produce metallic glasses, the cooling rate must be rapid enough, i.e., on the order of a million degrees centigrade per second, to circumvent crystallization which would otherwise occur. Even at the high cooling rates typically used, only alloys of certain compositions can be made amorphous by quenching from the malt. One class of metallic alloys consists of "glass-forming' metalloid atoms, e.g., phosphorous, boron, silicon, and carbon as required additions; usually in the 10 to 25 atomic percent range.

One technique for obtaining the very rapid cooling rates required is chill block melt-spinning, as described in U.S. Pat. No. 4,177,856, incorporated herein by reference in its entirety. Continuous melt-quenching techniques such as melt-spinning are very attractive from a production standpoint in that large amounts of thin glassy alloy filament, tape, etc., may be cast at speeds typically up to 50 m/s. Unless special equipment is used to guide and coil the filament, it will be cast from the spinning chill block into piles having an intertwined or tangled appearance as newly formed portions of the continuous filaments fall into open areas between previously ejected portions.

Metallic glasses undergo inhomogeneous plastic deformation through the formation of highly localized shear bands at temperatures well below the glass transition temperature, $T_g$. At temperatures well below $T_g$, these high strength, high modulus materials have fracture stresses marginally greater than the yield stress and do not exhibit substantial elongation in tension. In contrast, the mode of plastic deformation near $T_g$ is one in which the macroscopic strain in the specimen results from homogeneous deformation by viscous-like flow throughout the entire sample volume. The "plastic" transition temperature, $T_p$, corresponds to the changeover from one deformation mode to the other.

Discussion of the deformation behavior of glassy metallic alloys as a function of temperature appears not infrequently in the literature, e.g., Japanese Pat. No. S.53 (1978)-57170 of May 24, 1978 to T. Masumoto. In his patent, Masumoto describes the temperature regime between the crystallization temperature and the "ductile" transition temperature, in which uniform deformation easily occurs. Masumoto also proposes that forming processes such as rolling, punching, pressing, pulling out, and bending will be viable in that temperature regime; however, his examples are restricted to the rolling, pulling out and bending processes on a single ribbon and are primarily designed to demonstrate feasibility of easy deformation in the subject temperature regime.

One significant drawback to the utilization of glassy metallic alloys is that at the present time they can only be produced from the melt in large quantities in the form of filaments, ribbons, or flakes having thicknesses on the order of up to about 0.01 cm. If the processing parameters are changed to produce thicker ribbon, it is generally not possibly to also obtain the very rapid cooling rates through the entire cross section required to avoid incipient crystallization. A second drawback is that the crystallization temperature forms an upper bound on the temperature to which the alloy may be heated in attempts to form large glassy metallic shapes from glassy filaments or ribbons.

The use of binders to agglomerate ribbons or flakes described, for example, in U.S. Pat. Nos. 4,197,146 and 4,201,837 to Frischmann and Lupinski, respectively, incorporated herein by reference, does not alleviate the drawback related to the crystallization temperature of the alloy and is also subject to temperature limits based on decomposition of the binder. Also, the presence of the binder inhibits development of properties projected for 100% dense bodies since some portion of the volume is occupied or made discontinuous by the presence of the binder.

Components or bodies formed from flakes (as described in U.S. Pat. No. 4,197,146, referenced above), discontinuous ribbon segments (as described in U.S. Pat. No. 4,201,837, referenced above), and powders without binders are subject to additional costs involved in making suitable flakes, discontinuous ribbon segments and powders compared to the costs of producing ribbons. Also, although physical properties are substantially uniform along the length of ribbons, such uniformity is generally not to be found among flakes, discontinuous ribbon segments or powders. Such variations in the form of end effects are particularly to be expected where the flakes or discontinuous ribbon segments are produced from the melt on casting wheels having local lines of low conductivity which may cause the formation of lines of brittle crystalline material along which the cast material fractures to define the flakes. It has generally been observed that components formed with or without binders have poorer soft magnetic characteristics than the flakes or discontinuous ribbon segments from which they are formed.

It is, therefore, an object of this invention to provide a binderless method for the consolidation of continuous filaments of glassy metallic alloys to form dense self-supporting glassy metallic alloy bodies of substantially uniform composition.

Another object of this invention is to provide discrete self-supporting glassy metallic alloy bodies of substantially uniform composition having properties substantially the same as those of the filamentary glassy material from which they are formed.

A further object of this invention is to provide dense discrete glassy magnetic metallic bodies of substantially uniform composition having superior soft magnetic properties substantially the same as those of the filamentary glassy soft magnetic material from which they are formed.

Other objects of this invention will, in part, be obvious and will, in part, appear hereinafter.

BRIEF DESCRIPTION OF THE INVENTION

In accordance with the teachings of this invention, there is provided a method by which filaments of a glassy metallic alloy are consolidated under heat and pressure by uniaxial pressing to form discrete self-supporting glassy metallic alloy bodies of substantially uniform composition.

In its method aspect, this invention briefly described includes the steps of distributing, in an essentially uniform manner, a preselected amount of filamentary glassy metallic alloy into an open-ended compacting volume and uniaxially compressing the filamentary alloy for a sufficient period of time at a temperature of at least its plastic transition temperature, but less than its crystallization temperature, to produce a consolidated dense discrete metallic body.

In its product or article aspect, this invention takes the form of a dense discrete self-supporting metallic body having an atomic structure that is at least 50% glassy with any remainder crystalline and whose initial shape is determined by the shape of the open-ended compacting volume. Components or articles of manufacture requiring high strength, high hardness, wear resistance, and corrosion resistance are particularly desirable and useful products of this invention.

By starting with a magnetically soft filamentary magnetic alloy and performing the consolidation in accordance with the special steps of this invention, a dense discrete self-supporting body having essentially the same soft magnetic properties as the parent filaments and an atomic structure that is at least 50% glassy with any remainder crystalline can be produced.

DETAILED DESCRIPTION OF THE INVENTION

Figure 1:
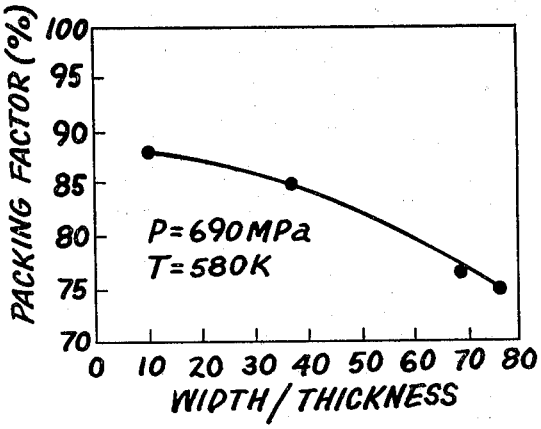
FIG. 1 shows the variation in packing factor as a function of the width-to-thickness ratio of the starting filamentary alloy for a given uniaxial compaction pressure and temperature for $Fe_{40}Ni_{40}B_{20}$ glassy alloy.

In accordance with the invention, discrete self-supporting bodies having a structure at least 50% glassy in nature, with any balance crystalline, are consolidated from an intertwined, tangled or otherwise three-dimensionally randomly-disposed loose agglomeration of filaments of a glassy metallic alloy. For the purpose of this invention, filaments are the thin product of the chill block melt-spinning process having lengths of at least several feet and width-to-thickness ratios of less than about 600:1. These filaments have substantially parallel opposed major surfaces, i.e., top and bottom surfaces which are defined by the width and length dimensions of the ribbons. Edge surfaces, defined by the thickness and length or the thickness and width dimensions, having significantly less surface area than the top major surfaces, interconnect the top and bottom surfaces.

Initial attempts at consolidating glassy metallic alloys by uniaxial pressing at temperatures less than the plastic transition temperature, $T_p$, were unsuccessful irrespective of the pressure applied. One such attempt to press filaments of $Fe_{40}Ni_{40}B_{20}$ at room temperature at ~0.7 GPa (~100 ksi) pressure resulted in a sample with substantial delamination between the major surfaces of adjacent filaments. "Bonding" between filaments to the extent that it occured was by simple mechanical interlocking resulting from permanent kinks in the filaments formed by inhomogeneous deformation while under load.

Additional experiments were then conducted and in one such experiment, ten 15 mm×15 mm×40 mm μm platelets of $Fe_{40}Ni_{40}B_{20}$ alloy were cut from a length of wide glassy alloy filament and carefully stacked and loaded into a die for uniaxial compression normal to the top and bottom major faces of the platelets. A compressive stress of ~0.7 GPa applied for 1800 seconds at 560 K. failed to result in any adhesion or bonding between adjacent platelets. There were some signs of interfacial conformation in that surface asperities between neighboring platelets were mutually reproduced and this experiment established that elevated temperature alone would be insufficient to achieve satisfactory interfilamentary conformation and bonding.

In accordance with this invention, it has been determined that in addition to elevated temperatures in a particular range, shear stress is also a required parameter. The importance of shear is supposedly threefold in that it: (1) assists in obtaining geometric conformity between adjacent surfaces, (2) increases plastic flow and contacting interfacial area, and (3) disrupts oxide and other contaminant films. The introduction of shear forces into a uniaxial process seemed impossible at first until in the course of the invention advantage was taken of the intertwined three-dimensionally random nature of the filaments to generate the shear. In an experiment, filaments were loosely loaded into a die with no effort to carefully stack and arrange them as was previously done and pressed at a temperature greater than the plastic transition temperature but less than the crystallization temperature of the alloy. That experiment was successful in producing a dense self-supporting body.

Further experiments were conducted to refine the process. A key experimental discovery was that the magnitude of the shear stress component was a function of the filament dimensions and orientation, which in turn, directly affected the extent of consolidation, i.e., density, as measured by the filament packing factor (PF). The filament packing factor is calculated by dividing the measured density of the pressing by the known density of the constituent glassy alloy filaments. FIG. 1, determined in the course of this invention, shows the variation of packing factors with the width-to-thickness (w/t) ratio of the filaments. The packing factors increases with decreasing width-to-thickness ratio and this is attributed to the statistically greater number of interfaces obliquely oriented with respect to the applied compression axis thus enhancing the opportunity for shear. As the dimensions of the compacting volume increase, the amount of shear that can be generated also increases permitting the compaction of ribbons having width-to-thickness ratios of up to about 600:1.

Figure 2:
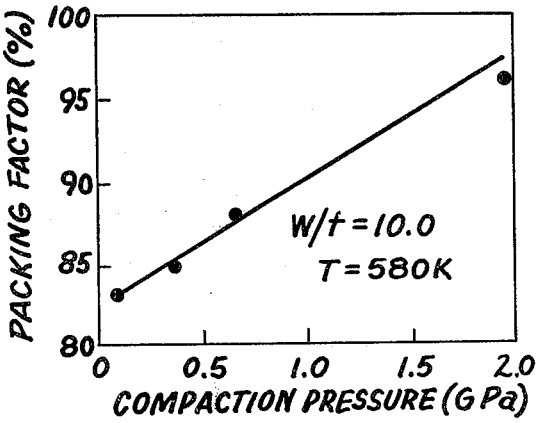
FIG. 2 shows the variation in packing factor as a function of uniaxial compaction pressure at one value of the width-to-thickness ratio and at one uniaxial compaction temperature.

It was also discovered that consolidation pressure influences the packing factor in the manner shown in FIG. 2. The steady increase in packing factor with warm-pressing pressure reflects an increasing extent of homogeneous flow with subsequently improved compliance between adjacent strands of filaments in the pressing.

With reference to the FIGURES, the physical practice of the invention may be explained in greater detail.

Figure 3:
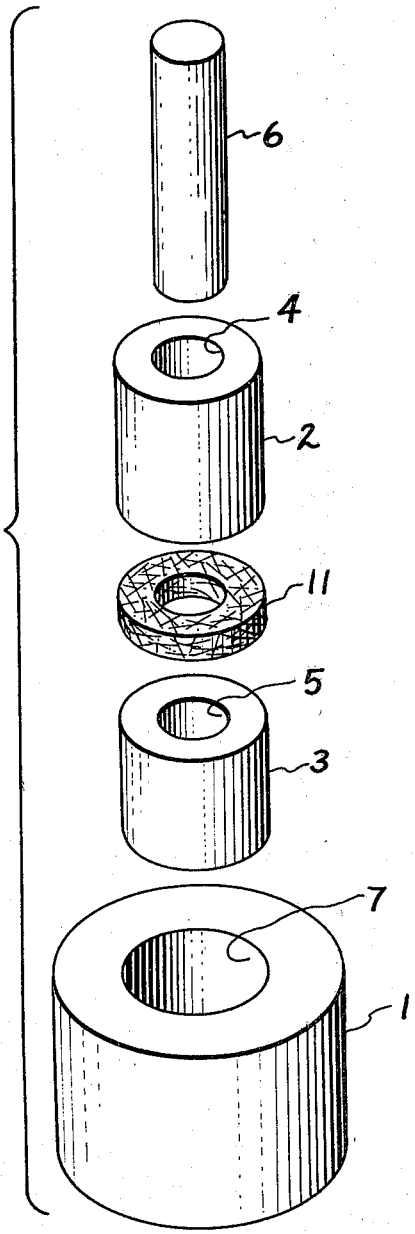
FIG. 3 is a disassembled isometric view of a typical die after uniaxial warm consolidation of glassy metallic alloy filaments.

FIG. 3 shows a die of the type well-known to those skilled in the art of powder metallurgy. In its most elementary and general form, such a die consists of a main body 1; upper 2 and lower 3 punches having open regions 4 and 5 extending therethrough, respectively; and a core rod 6. The main body 1 typically contains an open region 7 extending therethrough into which the upper 2 and lower 3 punches, core rod 7, and a predetermined powdered metal charge are inserted. In the configuration just described the die will produce a toroidal or annular product 11. By suitably configuring the die components, other usefully-shaped products may be formed.

For use in the uniaxial consolidation of filamentary glassy metal alloys, the main body 1 is typically placed onto the lower platen 8 of a metalworking press (not shown), the lower punch 3 is inserted into the open region 7, and the core rod 6 is inserted in the opening 5 in the lower punch. At this stage an open-ended compacting volume is formed between the main body 1, the lower punch 3 and the core rod 6. A preselected amount of loosely intertwined filamentary glassy metallic alloy material 10 is distributed substantially uniformly into the open-ended compacting volume. The intertwined or tangled filamentary material 10 is situated into the open-ended compacting volume using a suitably shaped tool. The amount of filamentary material selected will be determined by the size, primarily the thickness, of the object to be produced and the packing factor anticipated.

Figure 4:
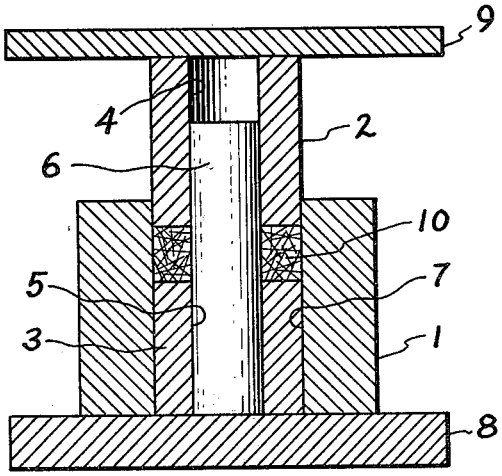
FIG. 4 is a view in cross section of the as-assembled die of FIG. 3 showing, in particular, the filamentary glassy metallic alloy in the compacting volume.
Figure 5:
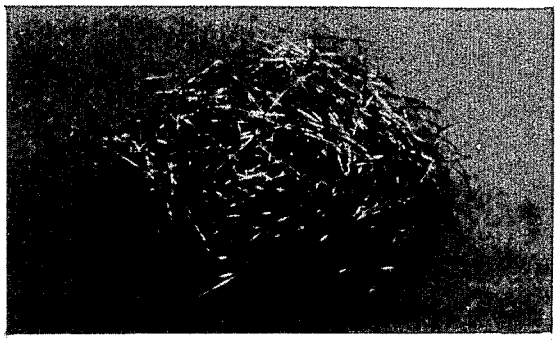
FIG. 5 is a photomacrograph of an intertwined three-dimensionally randomly disposed agglomeration of filamentary glassy metallic alloy.

After the open-ended compacting volume is filled with the preselected amount of filamentary material, the upper punch 2 is placed down over the core rod 6 into the unfilled portion of the compacting region to rest upon the filamentary charge 10 as shown in cross section in FIG. 4. The upper platen 9 of the metalworking press (not shown) is then brought to bear upon the upper punch 2 and a precompacting pressure of approximately 10% of the ultimate compacting pressure is applied. Following a warm-up period to permit the filamentary charge 10 to reach a substantially uniform temperature throughout of at least the plastic transition temperature, but less than the crystallization temperature of the alloy, the full compacting pressure is applied and the filamentary metallic charge is fused and densified to form a dense, solid, selfsupporting body 11. The heat may be applied, for example, by conduction through the platens, 8 and 9, from a heat source therein (not shown) or heat applied thereto. Alternatively, for example, the heat may come from induction coils (not shown) placed circularly about the main body 1, in a manner known to those skilled in the art of induction heating, or from a known and commercially available heater tape (not shown) wrapped about main body 1. Rapid heating by the induction heating process has been found to be advantageous in that such rapid heating minimizes the time at which the filaments are exposed to high temperature prior to application of the full compaction pressure. This minimizes structural relaxation and consequently permits greater homogeneous flow during compaction than if the heat is slowly applied.

The filling of the open-ended compacting volume may also proceed in stages wherein the open-ended volume is filled with a portion of the preselected amount of filamentary material and the upper punch 2 used to partially compress the material in the die. Partial compression to about at least 50%, but less than about 60% of the theoretical density has been found to be most desirable.

A frequently observable distinctive feature of the bodies produced by this invention is that vestiges of the starting filamentary material persist in the consolidated bodies. Under influence of the uniaxial compressive stresses and applied heat, the three-dimensionally randomly disposed top and bottom major surfaces of the filamentary starting material are generally rearranged to form pseudo layers wherein the flat top and bottom surfaces are stacked substantially one on top of another, substantially perpendicular to the applied uniaxial compressive stress, and bonded together. In the two-dimensional plane of any pseudo layer, the flat ribbons are randomly oriented with respect to each other. Bonding between mating portions of the filamentary material has been found to be metallurgical in nature having aspects of true diffusion bonding and aspects typical of that which characterizes the solid phase welding of crystalline materials. The bonding is generally strongest in those areas which have experienced the greatest amount of shear.

It has also been discovered that the filamentary glassy metallic charge 10 may be inserted into the compacting region by any convenient means except when it is desired to produce a consolidated body having soft magnetic properties approaching those of magnetically soft filamentary starting material. In that case, it has been discovered that the introduction of permanent deformation in the form of shear bands, with their attendant stress fields, is detrimental to the ultimate goal of producing a body having soft magnetic properties approaching those of the magnetically soft filamentary starting material. Once the shear bands have been introduced, their effects cannot be completely mitigated by thermal processes such as annealing and they remain to the detriment of the production of consolidated bodies having very low coercive forces.

To produce consolidated bodies having the desirable soft magnetic properties, the filamentary material is best preheated to a temperature of at least its plastic transition temperature, but less than its crystallization temperature and then carefully loaded into the open-ended compacting volume, without exceeding the yield stress of the alloy, in a die which has also been preheated to a temperature of at least the plastic transition temperature, but less than the crystallization temperature of the filamentary soft magnetic metallic alloy. Also, in this case, the filling is best accomplished in one iteration, the upper punch 2 preheated to essentially the temperature of the die, and the pressure applied slowly, i.e., at a strain rate on the order of $10^{-5}$ $sec^{-1}$ up to the full compacting pressure to avoid damage to the filamentary material due to strain rate effects. Disassembly of the die and recovery of the consolidated body immediately following completion of the uniaxial compression before the die has cooled more than a few degrees minimizes the possibility of introducing inhomogeneous strains which would tend to denigrate the soft magnetic properties. Subsequent annealing, particularly in the presence of a magnetic field, may be required to optimize the soft magnetic properties of the consolidated body.

The following examples illustrate the invention and set forth the best mode presently contemplated for its practice.

EXAMPLE 1

Figure 6:
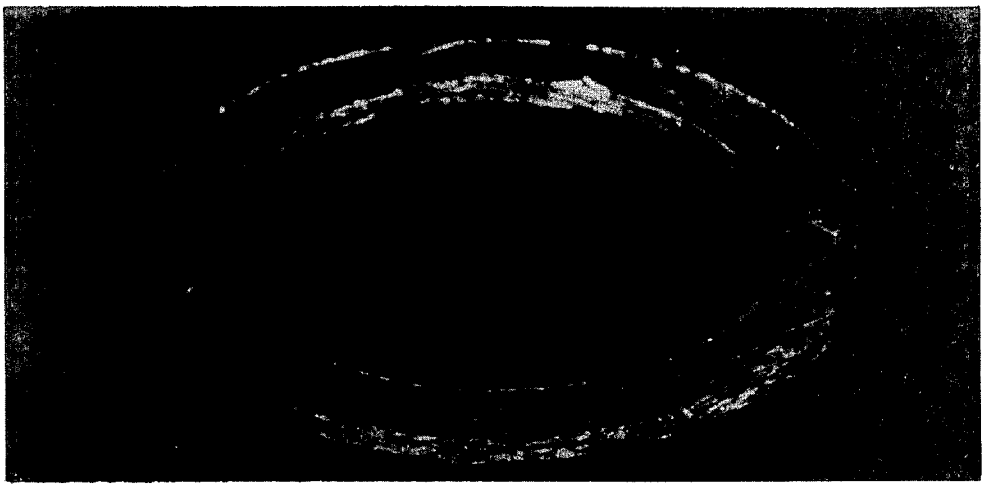
FIG. 6 shows a discrete self-supporting body in the form of a toroid produced by the method of the invention.

A 12.1 gram mass of glassy metallic alloy of composition $Fe_{40}Ni_{40}B_{20}$ in filamentary form having a width-to-thickness ratio of 10.0 was uniformly distributed by hand into the compacting volume of a die. The compacting volume was configured to yield a product in the shape of a toroid. The upper punch was inserted into the die and the assembly was precompacted cold under ~70 MPa pressure between preheated platens of a typical laboratory-type metalworking press in order to assure good interfacial heat transfer between press platen, die, and the filaments. Full compaction pressure of 0.69 GPa was applied following a 2400 second die warm-up time. Press platen heater power was shut off after a pressing time of 1800 seconds had elapsed and coolant water was circulated for 1800 seconds through the platens with the sample still under the full pressing load. After cooling to ambient temperature, the die assembly was removed from the press and measurements of the physical dimensions were taken by micrometer. An experimental packing factor of 88% was determined by dividing measured mass by specimen volume calculated from specimen dimensions. The resulting product is shown in FIG. 6.

EXAMPLE 2

Following the general procedure of Example 1, 14.6 grams of $Fe_{81.5}B_{14.5}Si_4$ filaments having a width-to-thickness ratio of 75 were uniaxially warm pressed with a pressure of 0.69 GPa for 600 seconds at 600 K to form a toroid having a packing factor of 75%.

EXAMPLES 3–9

The general procedure of Example 1 was repeated employing the specific process conditions and alloys summarized in the Table below to produce solid discs having the packing factors listed in the Table.

TABLE

| Example | | Mass (Grams) | Width to Thickness ratio | Pressing Temp. (K) | Pressing Pressure (GPa) | Pressing Time (sec) | Packing Factor (%) |
|---|---|---|---|---|---|---|---|
| 3 | $Fe_{40}Ni_{40}B_{20}$ | 3.5 | 68.8 | 580 | 0.69 | 1800 | 78 |
| 4 | $Fe_{40}Ni_{40}B_{20}$ | 3.5 | 36.7 | 580 | 0.69 | 1800 | 85 |
| 5 | $Fe_{40}Ni_{40}B_{20}$ | 3.5 | 10.0 | 580 | 0.69 | 1800 | 88 |
| 6 | $Fe_{40}Ni_{40}B_{20}$ | 3.5 | 10.0 | 580 | 0.38 | 1800 | 85 |
| 7 | $Fe_{40}Ni_{40}B_{20}$ | 3.5 | 10.0 | 580 | 0.08 | 1800 | 83 |
| 8 | $Fe_{81.5}B_{13.5}Si_{2.5}C_{2.5}$ | 73 | 30 | 620 | 2 | 80 | 96 |
| 9 | $Fe_{40}Ni_{40}B_{20}$ + $Co_{80}B_{20}$ | 14.3 | 35 | 660 | 0.69 | 1800 | — |

Figures 7A, 7B, 7C:
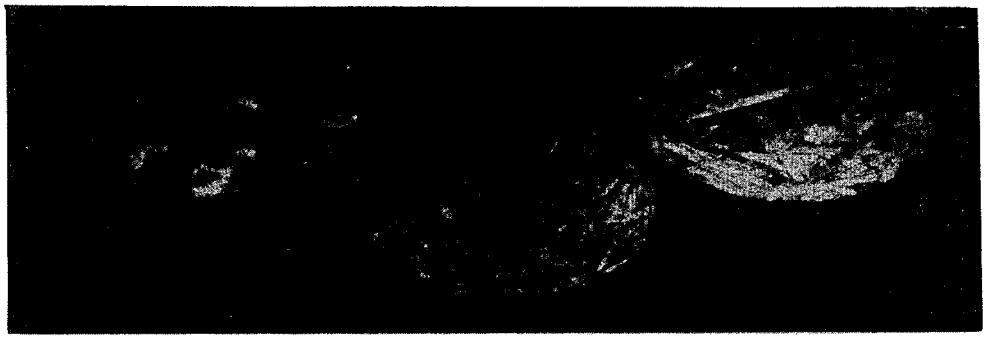
FIGS. 7 A, B and C show three discrete dense self-supporting bodies in the form of solid discs produced by the method of the invention.

The products of Examples 3, 4 and 5 are shown in FIGS. 7A, 7B and 7C, respectively. These Examples, involving filaments of decreasing width-to-thickness ratios, clearly illustrate the increased packing factors obtained by the increased shearing action discovered in the course of this invention to be a function of the decreasing width-to-thickness ratios.

EXAMPLE 10

Filaments of glassy magnetic metallic alloy, weighing about 4 grams, of nominal composition $Fe_{81.5}B_{14.5}Si_4$ with a width-to-thickness ratio of 65 were carefully loaded, without exceeding the yield stress of the alloy, into a die preheated to 623 K. Following a holding period of about 5 minutes to permit the temperature of the filaments to equilibrate with that of the die, an upper punch preheated to 623 K was used to close the die. Uniaxial pressure was gradually applied over about a 1 minute period until the maximum of 6.8 GPa was attained. The maximum pressure was maintained for 30 minutes and then released. The die was disassembled and a toroid having an inside diameter of 4.8 cm, an outside diameter of 5.4 cm, and a thickness of 2.2 mm was recovered.

The measured coercivity of the as-consolidated toroid was 460 mOe using a drive field of 1 Oe. Following an anneal at 630 K for 3 hours, the measured coercivity of the toroid was 250 mOe. In comparison, samples of $Fe_{81.5}B_{14.5}S_4$ filament cold rolled to 35% reduction in area exhibited coercivities on the order of 50 Oe in a 1 Oe drive field. After annealing the cold rolled ribbon at 630 K for 3 hours coercivities on the order of 500 mOe were measured.

I claim:

1. The method of producing a consolidated dense discrete metallic body comprising the steps of:
   (a) defining an open-ended compacting volume;
   (b) distributing a preselected amount of intertwined filamentary glassy metallic alloy substantially uniformly into said open-ended compacting volume, said filamentary alloy having a width-to-thickness ratio of less than about 600:1; and
   (c) uniaxially compressing said preselected amount of said filamentary alloy with a pressure for a period of time sufficient to produce thereby a consolidated dense discrete metallic body that is at least 50% glassy, with any remainder crystalline, while maintaining said filamentary alloy at a substantially uniform temperature throughout of at least its plastic transition temperature, but less than its crystallization temperature.

2. The method of claim 1 wherein said open-ended compacting volume is formed in a partially assembled die.

3. The method of claim 2 further including the step of inserting a punch into said die to close said open-ended compacting volume prior to initiating the uniaxial compression step thereby completing the assembly of said die containing said preselected amount of said filamentary alloy.

4. The method of claim 1 wherein the distributing step is accomplished by repeatedly partially filling said open-ended compacting volume with a portion of said preselected amount of said filamentary alloy and partially compacting said portion of said filamentary alloy to a substantially uniform packing density of about at least 50% to no more than about 60% until said open-ended compacting volume is filled with said preselected amount of said filamentary alloy.

5. The method of claim 2 wherein an induction heating coil surrounding said die is used to rapidly heat said preselected amount of said filamentary alloy to the requisite substantially uniform temperature to be maintained during the compressing step.

6. A consolidated dense discrete self-supporting metallic body having an atomic structure that is at least 50% glassy with any remainder crystalline, said body being prepared in accordance with the method of claim 1.

7. The body of claim 6 in which the atomic structure is totally glassy.

8. The body of claim 6 in which the density is at least 80%.

9. The method of producing a magnetically soft consolidated dense discrete body comprising the steps of:
   (a) defining an open-ended compacting volume;
   (b) distributing a preselected amount of intertwined magnetically soft filamentary glassy metallic alloy, preheated to a temperature of at least its plastic transition temperature, but less than its crystallization temperature, substantially uniformly into said open-ended compacting volume without exceeding the elastic limit of said alloy while maintaining said die at a substantially uniform temperature throughout of at least the plastic transition temperature, but less than the crystallization temperature of said alloy, said magnetically soft filamentary alloy having a width-to-thickness ratio of less than about 600:1; and
   (c) uniaxially compressing said preselected amount of magnetically soft filamentary glassy metallic alloy with a gradually applied pressure for a period of time sufficient to produce thereby a magnetically soft consolidated dense discrete metallic body that is at least 50% glassy, with any remainder crystalline, while maintaining said filamentary alloy at a substantially uniform temperature throughout of at least its plastic transition temperature, but less than its crystallization temperature; and
   (d) disassembling said die following completion of said uniaxial compression step recovering thereby a magnetically soft metallic body in a substantially strain-free condition.

10. The method of claim 9 wherein said open-ended compacting volume is formed in a partially assembled die.

11. The method of claim 10 further including the step of inserting a punch heated to a substantially uniform temperature throughout of at least the plastic transition temperature, but less than the crystallization temperature of said glassy metallic alloy, into said die to close said open-ended compacting volume prior to initiating the uniaxial compression step thereby completing the assembly of said die containing said preselected amount of said filamentary glassy metallic alloy.

12. The method of claim 9 further including the step of annealing the recovered substantially strain-free magnetically soft body at a temperature less than its crystallization temperature.

13. The method of claim 12 wherein said annealing is conducted in the presence of a magnetic field.

14. A magnetically soft consolidated dense discrete self-supporting body having a low coercive field, a high permeability and an atomic structure that is at least 50% glassy with any remainder crystalline, said body being prepared in accordance with the method of claim 9.

15. The body of claim 14 in which the atomic structure is totally glassy.

16. The body of claim 14 in which the density is at least 80%.

17. The body of claim 14 in which the coercive field is less than 250 millioersteds.

* * * * *